US009136027B2

(12) United States Patent
Chang et al.

(10) Patent No.: US 9,136,027 B2
(45) Date of Patent: Sep. 15, 2015

(54) METHOD OF DRYING HIGH-LEVEL RADIOACTIVE WASTES AND DEVICE THEREOF

(71) Applicants: Kuo-Yuan Chang, Taoyuan County (TW); Jhong-Heng Chen, Taoyuan County (TW)

(72) Inventors: Kuo-Yuan Chang, Taoyuan County (TW); Jhong-Heng Chen, Taoyuan County (TW)

(73) Assignee: INSTITUTE OF NUCLEAR ENERGY RESEARCH, Jiaan Village, Longtan, Taoyuan (TW)

( * ) Notice: Subject to any disclaimer, the term of this patent is extended or adjusted under 35 U.S.C. 154(b) by 47 days.

(21) Appl. No.: 13/947,024

(22) Filed: Jul. 20, 2013

(65) Prior Publication Data

US 2015/0020405 A1 Jan. 22, 2015

(51) Int. Cl.

| | |
|---|---|
| ***G21F 9/00*** | (2006.01) |
| ***G21F 9/28*** | (2006.01) |
| *G21F 9/30* | (2006.01) |

(52) U.S. Cl.

CPC .... *G21F 9/28* (2013.01); *G21F 9/30* (2013.01)

(58) Field of Classification Search

USPC ..... 34/343, 361, 412, 448; 588/1, 16

See application file for complete search history.

(56) References Cited

U.S. PATENT DOCUMENTS

| | | | | |
|---|---|---|---|---|
| 4,773,997 | A * | 9/1988 | Butte | 210/282 |
| 7,096,600 | B2 * | 8/2006 | Singh | 34/494 |
| 7,707,741 | B2 * | 5/2010 | Singh | 34/443 |
| 8,266,823 | B2 * | 9/2012 | Singh | 34/565 |
| 2008/0076953 | A1 * | 3/2008 | Singh et al. | 588/16 |
| 2008/0214886 | A1 * | 9/2008 | Franklin et al. | 588/19 |
| 2009/0069621 | A1 * | 3/2009 | Singh et al. | 588/16 |

* cited by examiner

*Primary Examiner* — Nina Bhat

(57) ABSTRACT

A method of drying high-level radioactive wastes and device thereof contains a suspension mechanism for hanging a manual elevating mechanism, and a shielding cover. The manual elevating mechanism couples with a basket for accommodating wastes by using a hanging rope, and the shielding cover is fixed below the suspension mechanism and in a moving path of the basket. The basket is moved to a storage tank containing water in which radioactive wastes are stored, and the radioactive wastes are pumped into the basket by means of a pump. The basket is then lifted above a water surface of the storage tank and received in the shielding cover, and then the shielding cover is moved into a water holder so as to drain waters in the basket. The basket is further moved onto a heating seat to be heated and a vacuum equipment is started to dry the radioactive wastes.

4 Claims, 6 Drawing Sheets

METHOD OF DRYING HIGH-LEVEL RADIOACTIVE WASTES AND DEVICE THEREOF

BACKGROUND OF THE INVENTION

The present invention relates to a method of drying high-level radioactive wastes and device thereof which are capable of preventing exposure of persons working in a drying process in high high-level radioactive environment and enhancing safety of persons and storage.

To avoid radioactive contamination, radioactive wastes are stored under water. However, the spaces for storing radioactive wastes under water are limited, the radioactive wastes are accordingly moved out of water to be dried and then stored in containers. However, waters contained in the radioactive wastes generate a chemical change during evaporation or accumulation. In addition, in a drying process of the radioactive wastes, air resulting from evaporation accumulates or freezes in the containers easily, such that the containers are corroded and leak radioactive substances. The present invention has arisen to mitigate afore mentioned disadvantages.

SUMMARY OF THE INVENTION

The primary object of the present invention is to provide a method of drying high-level radioactive wastes and device thereof which are capable of preventing exposure of persons working in a drying process in high high-level radioactive environment and enhancing safety of persons and storage.

Further object of the present invention is to provide a method of drying high-level radioactive wastes and device thereof which are capable of eliminating waters in the radioactive wastes so as to dry the radioactive wastes.

Another object of the present invention is to provide a method of drying high-level radioactive wastes and device thereof which are capable of eliminating waters in the radioactive wastes so as to dry the radioactive wastes by ways of shielding and isolating means.

To obtain the above objectives, a method of drying high-level radioactive wastes includes steps of:

S11. placing a basket into a water tank in which radioactive wastes are stored and collecting the radioactive wastes in the basket, wherein a hanging device moves a basket to a storage tanks containing water in which radioactive wastes are stored, and the radioactive wastes B in the storage tanks are moved into the basket;

S12. moving the basket out of the water tank and placing the basket in a shielding cover; wherein the basket for collecting the radioactive wastes is lifted above a water surface of the storage tank and is received in the shielding cover so that the basket moves the radioactive wastes without exposing radiation;

S13. moving the basket into a water holder so as to drain water drops, wherein the basket is moved into a water holding groove of the water holder so as to drain the waters contained in the radioactive wastes;

S14. hanging the basket on a heating tray and connecting the shielding cover with a vacuuming equipment so as to dry the radioactive wastes, wherein a vacuum equipment is connected with the shielding cover so as to heat and vacuum free waters in the radioactive wastes.

A heating temperature of the heating tray is set at 200° C. A vacuum degree of the vacuum equipment is set at 120 torr as turning on the vacuum equipment, and a vacuum degree of the vacuum equipment is set at 100 torr as turning off the vacuum equipment.

In an operation of the heating tray and the vacuum equipment, the heating equipment is started to heat up to 200° C., and then the vacuum equipment is started, thereafter as a vacuum degree in the shielding cover decreases to 100 torr from at least 120 torr, the heating tray and the vacuum equipment are turned off.

A means of drying high-level radioactive wastes contains a drying device, and the drying device at least includes a suspension mechanism; a manual elevating mechanism mounted below the suspension mechanism and having a second hanging rope extending downwardly from a bottom end of the manual elevating mechanism and controlled to move upward and downward; a basket handed on the second hanging rope and including a storing space for receiving radioactive wastes, and a plurality of meshes formed on a bottom end of the storing space; a shielding cover fixed below the suspension mechanism and in a moving path of the basket, the shielding cover at least including a receiving chamber having a downward opening defined on a bottom end thereof so as to receive the basket, and an air drawing orifice arranged on receiving chamber; a heating seat including a heating tray for holding and heating the basket, thus preventing liquid substances from freezing without being removed; a vacuum equipment communicating with the air drawing orifice of the shielding cover so as to eliminate water vapors resulting from water fluids heated.

The drying device further includes a water holder, and the water holder includes a water holding groove for draining waters contained in the radioactive wastes.

The shielding cover includes a through hole formed at a central position thereof so as to insert a third hanging rope of the basket, and the manual elevating mechanism mounted below the shielding cover that synchronously drives a cap for covering the through hole.

The shielding cover includes a fixing portion extending outwardly from an outer peripheral side of the downward opening of the shielding cover, and the heating seat includes plural guiding plates mounted on an outer wall thereof and abutting against an external rim of the fixing portion so as to guide the shielding cover, thus fixing the basket on the heating tray.

The receiving chamber of the shielding cover has the fixing portion extending outwardly from the outer peripheral side of the downward opening thereof, and the water holding groove of the water holder has an opening for corresponding to a profile of the fixing portion.

The water holder also includes an outlet tube extending outwardly from an outer peripheral side of the water holding groove and a drain valve disposed on the outlet tube and used to turn on/off the outlet tube.

DETAILED DESCRIPTION OF THE PREFERRED EMBODIMENTS

Figure 1:
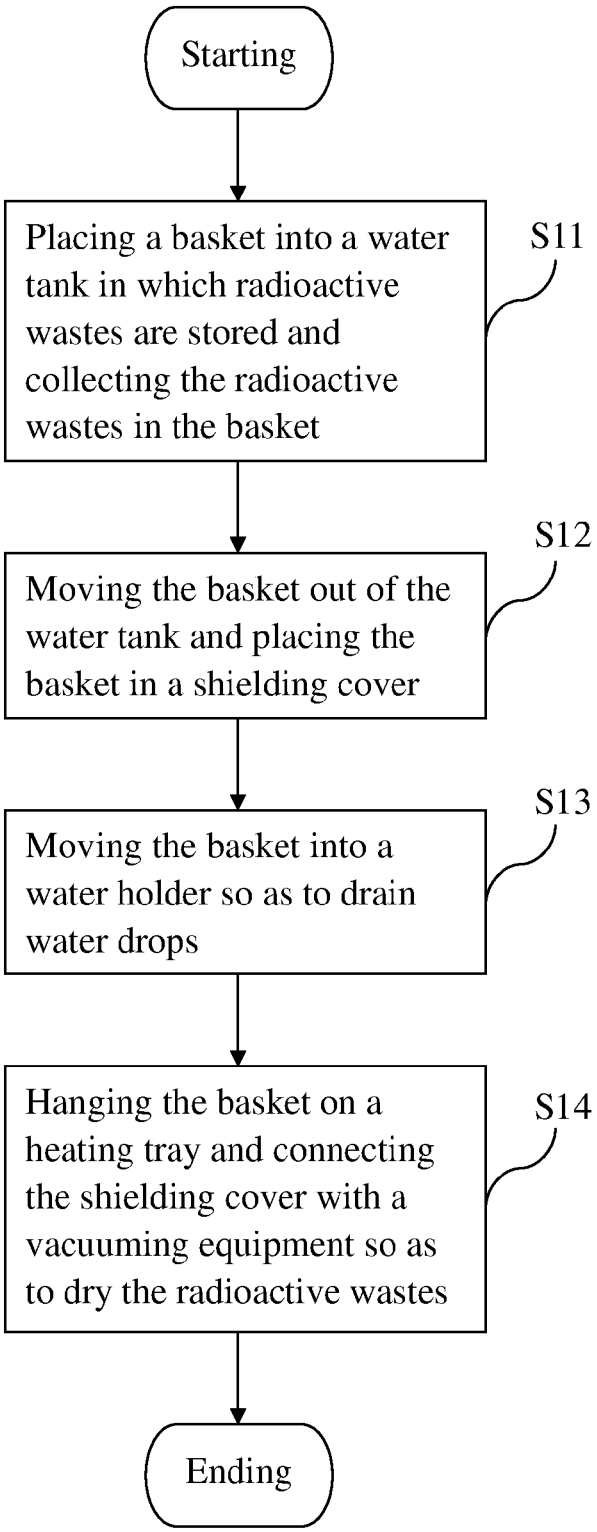
FIG. 1 is a flow chart showing steps of a method of drying high-level radioactive wastes according to a preferred embodiment of the present invention is applied.
Figure 2:
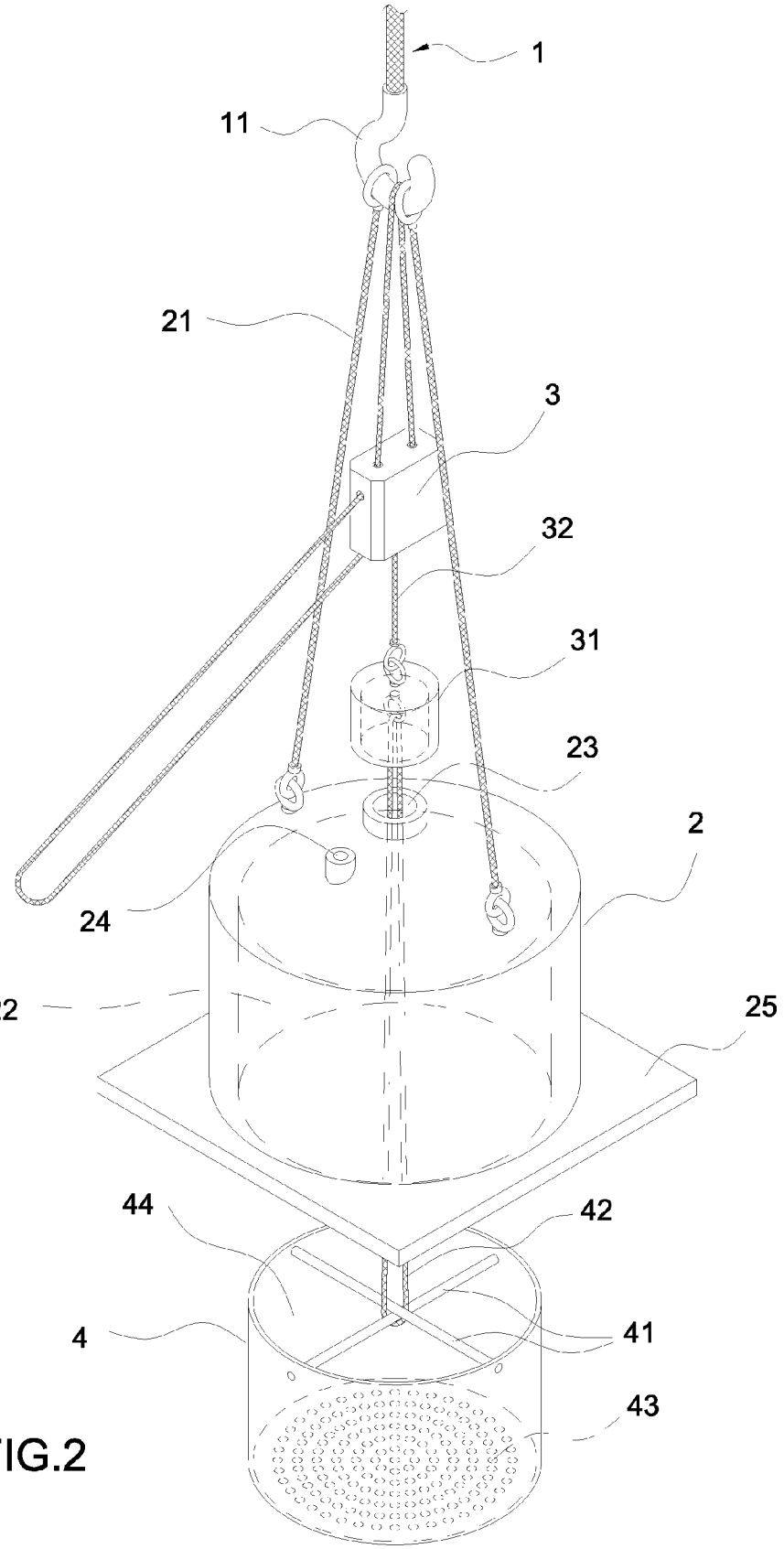
FIG. 2 is a perspective view showing the assembly of a suspension mechanism, a shielding cover, a manual elevating mechanism, and a basket of a hanging device according to the preferred embodiment of the present invention is applied.
Figure 3:
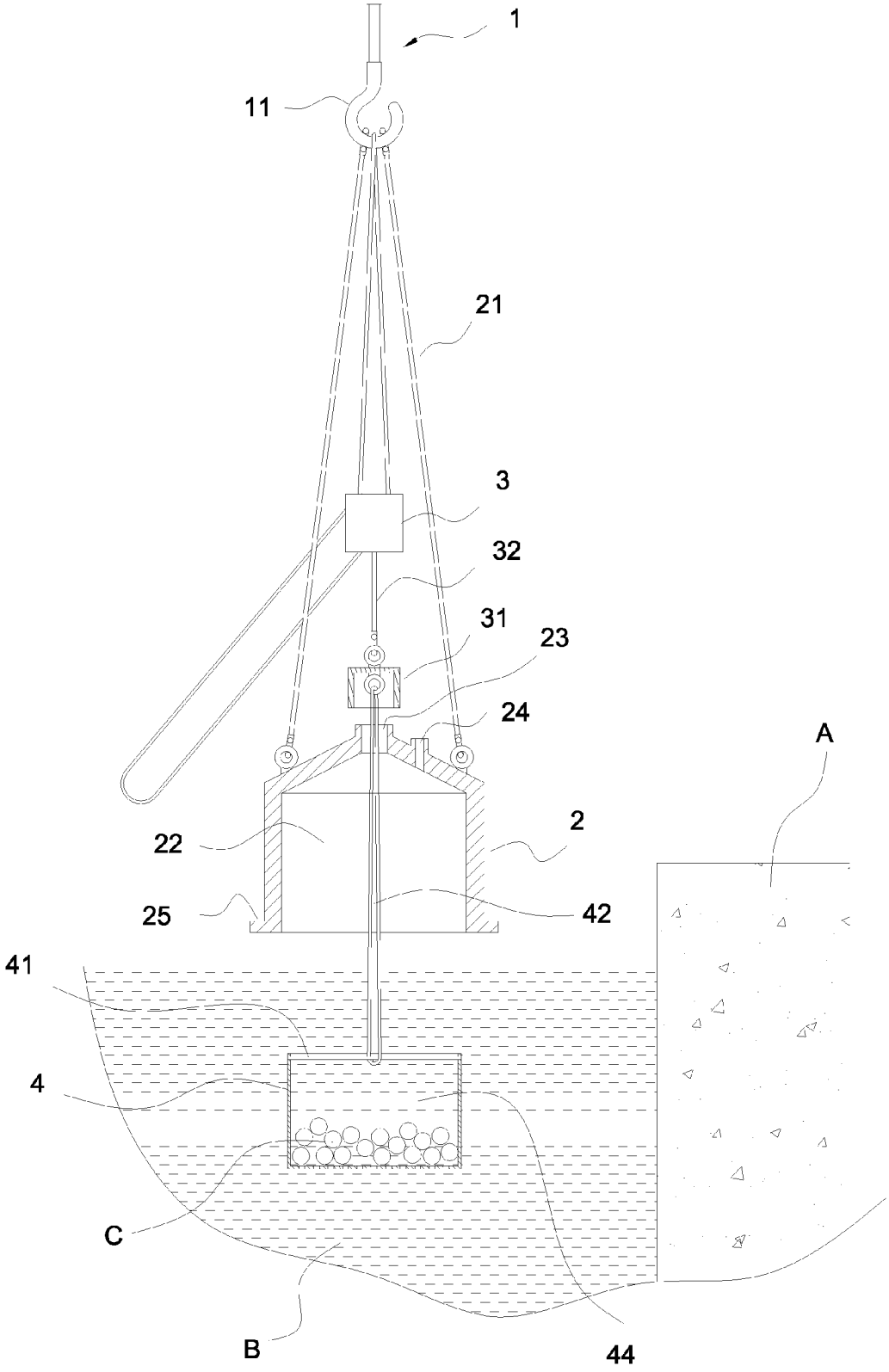
FIG. 3 is a plan view showing the operations of a device of drying high-level radioactive wastes according to the preferred embodiment of the present invention.

Referring further to FIGS. 1-2, a method of drying high-level radioactive wastes according to the present invention comprises steps of:

S11. placing a basket into a water tank in which radioactive wastes are stored and collecting the radioactive wastes in the basket;

S12. moving the basket out of the water tank and placing the basket in a shielding cover;

S13. moving the basket into a water holder so as to drain water drops;

S14. hanging the basket on a heating tray and connecting the shielding cover with a vacuuming equipment so as to dry the radioactive wastes.

A device of drying high-level radioactive wastes according to the present invention comprises: a suspension mechanism 1, a shielding cover 2, a manual elevating mechanism 3, a basket 4, a water holder 5, a heating tray 6, and vacuum equipment 7, wherein the suspension mechanism 1 includes a hook 11 which is moved vertically and horizontally.

The shielding cover 2 includes a plurality of first hanging ropes 21 for connecting with the hook 11 of the suspension mechanism 1, a receiving chamber 22 having a downward opening defined on a bottom end thereof, a fixing portion 25 extending outwardly from an outer peripheral side of the downward opening of the shielding cover 2, a through hole 23 formed at a central position of a top end of the receiving chamber 22, and an air drawing orifice 24 arranged on the top end of the receiving chamber 22 proximate to the through hole 23.

The manual elevating mechanism 3 is mounted below the hook 11 of the suspension mechanism 1 and includes a second hanging rope 32 extending downwardly from a bottom end of the manual elevating mechanism 3 and moved upwardly and downwardly, wherein the second hanging rope 32 couples with a cap 31.

The basket 4 includes a storing space 44 arranged therein and having an opening defined on a top end of the storing space 44, a plurality of meshes 43 formed on a bottom end of the storing space 44, two shafts 41 crossed together and fixed on the opening of the storing space 44, the two shafts 41 connecting with the cap 31 via the through hole 23 by ways of a third hanging rope 42 so as to form a hanging connection, and the shielding cover 2 is fixed in a path which the basket 4 moves.

The water holder 5 includes a water holding groove 51 for receiving the basket 4, the water holding groove 51 having an opening which corresponds to a profile of the fixing portion 25 so as to guide the basket 4, the water holder 5 also includes an outlet tube 52 extending outwardly from an outer peripheral side of the water holding groove 51 and a drain valve 53 disposed on the outlet tube 52 and used to turn on/off the outlet tube 52.

The heating seat 6 includes a heating tray 61 provided thereon, plural guiding plates 62 mounted on an outer wall thereof and abutting against an external rim of the fixing portion 25 so as to guide the shielding cover 2, such that the basket 4 is fixed on the heating tray 61 so as to be further heated by the heating tray 61, thus preventing liquid substances of the basket 4 from freezing.

The vacuum equipment 7 communicates with the air drawing orifice 24 of the shielding cover 2 through a discharging tube 71 and at least includes a vacuum pump, a solenoid valve, and a vacuum gauge so as to eliminate water vapors resulting from water fluids heated.

Referring further to FIGS. 1 and 3-6, in a step of S11, a hanging device (i.e., the suspension mechanism 1 and the manual elevating mechanism 3) moves the basket 4 to a storage tank A containing water in which radioactive wastes C, such as granular or powder wastes, are stored, and radiations of the radioactive wastes C are isolated by waters B. Also, the radioactive wastes B in the storage tanks A are guided into the basket 4 via a guiding tube (not shown) by means of a pump (not shown).

Figure 4:
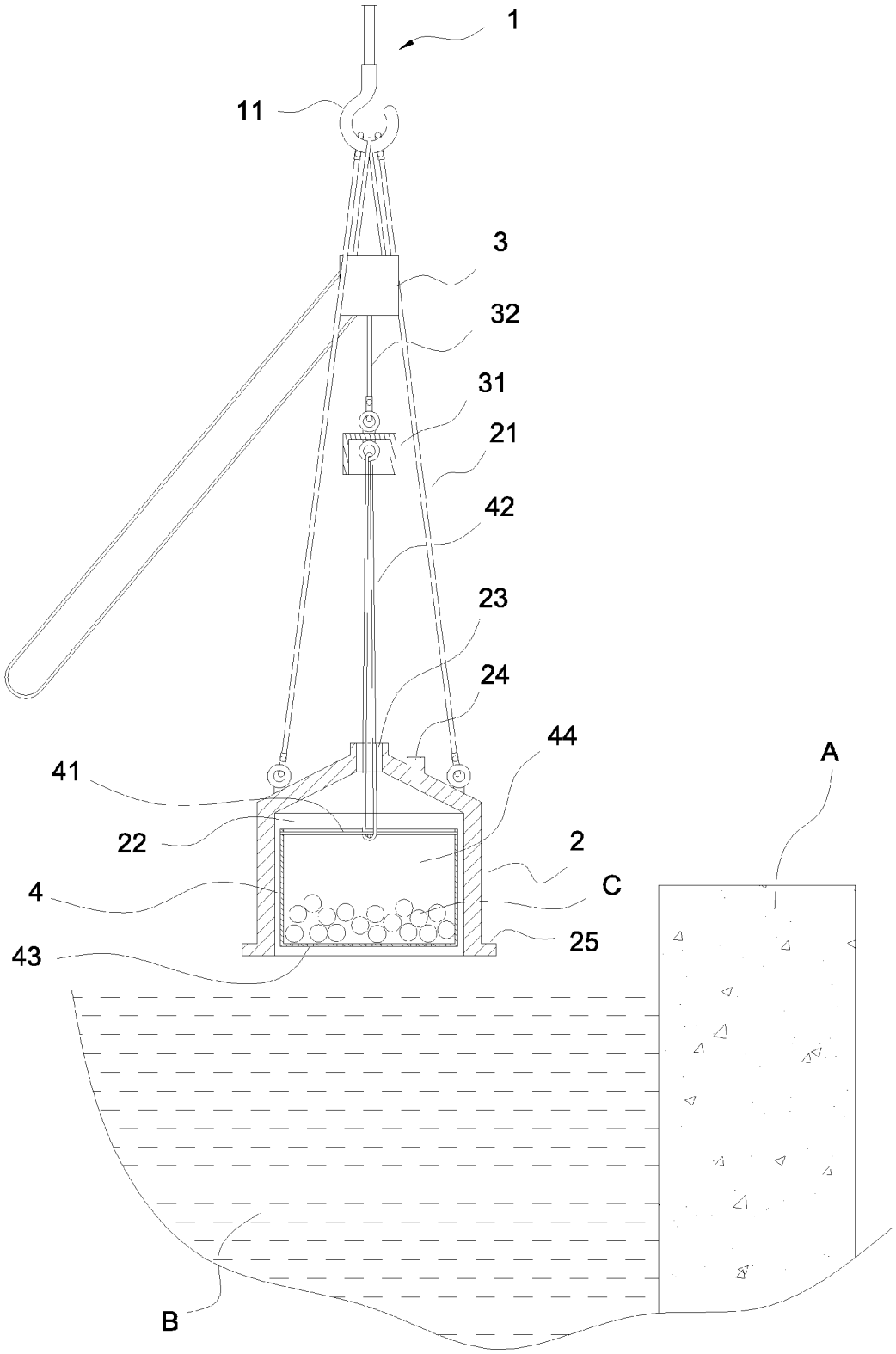
FIG. 4 is another plan view showing the operations of the device of drying high-level radioactive wastes according to the preferred embodiment of the present invention.

In a step of S12, the basket 4 for collecting radioactive wastes C is lifted above a water surface of the storage tank A and is received in the receiving chamber 22 of the shielding cover 2 (as illustrated in FIG. 4) so that in the shielding cover C, the waters B contained in the radioactive wastes C are dropped from the plurality of meshes 43 of the basket 4.

Figure 5:
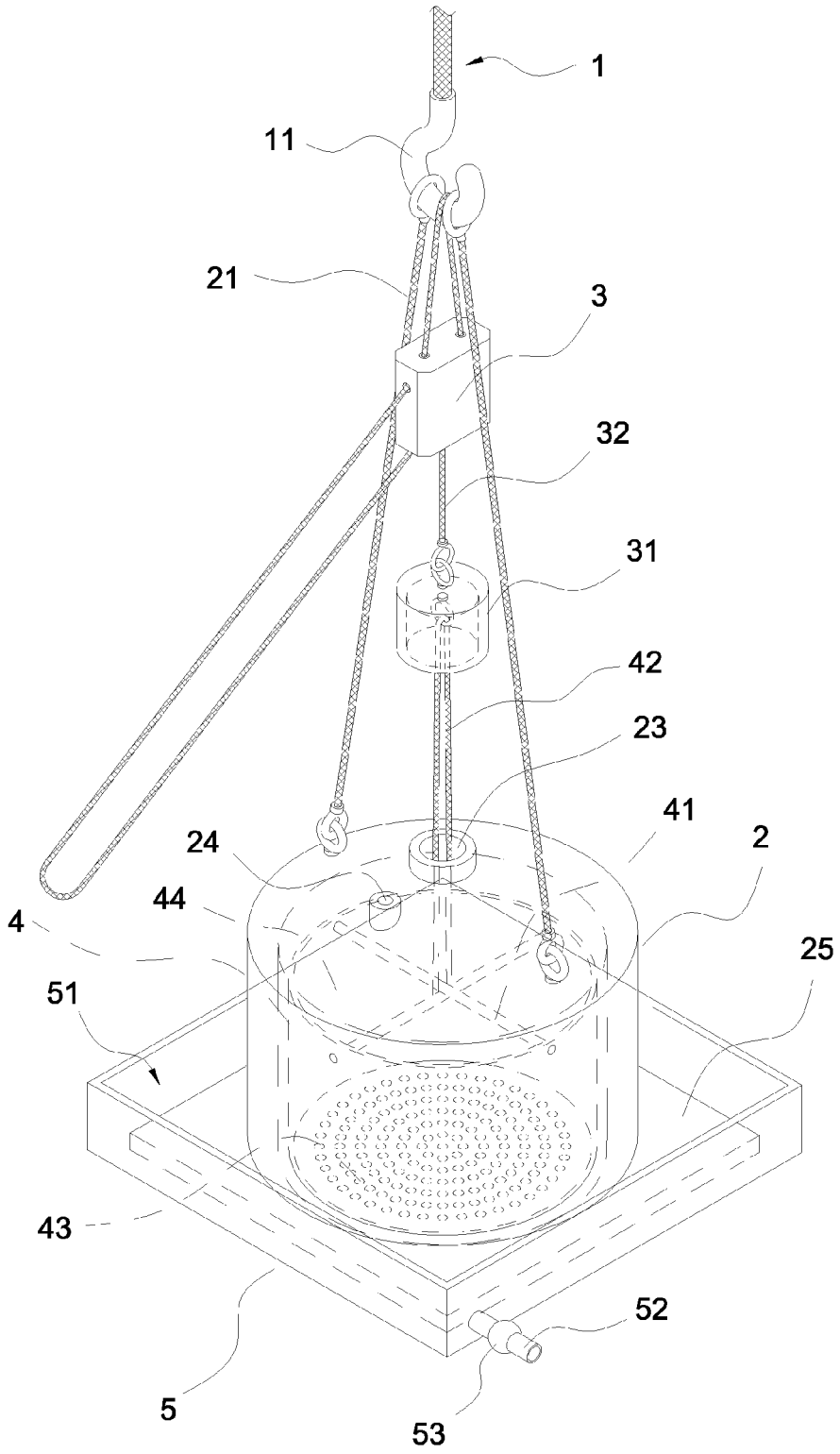
FIG. 5 is a perspective view showing the operations of the device of drying high-level radioactive wastes according to the preferred embodiment of the present invention.

In a step of S13, the basket 4 is moved into a water holding groove 51 of the water holder 5, as shown in FIG. 5, so as to drain the waters B contained in the radioactive wastes C.

Figure 6:
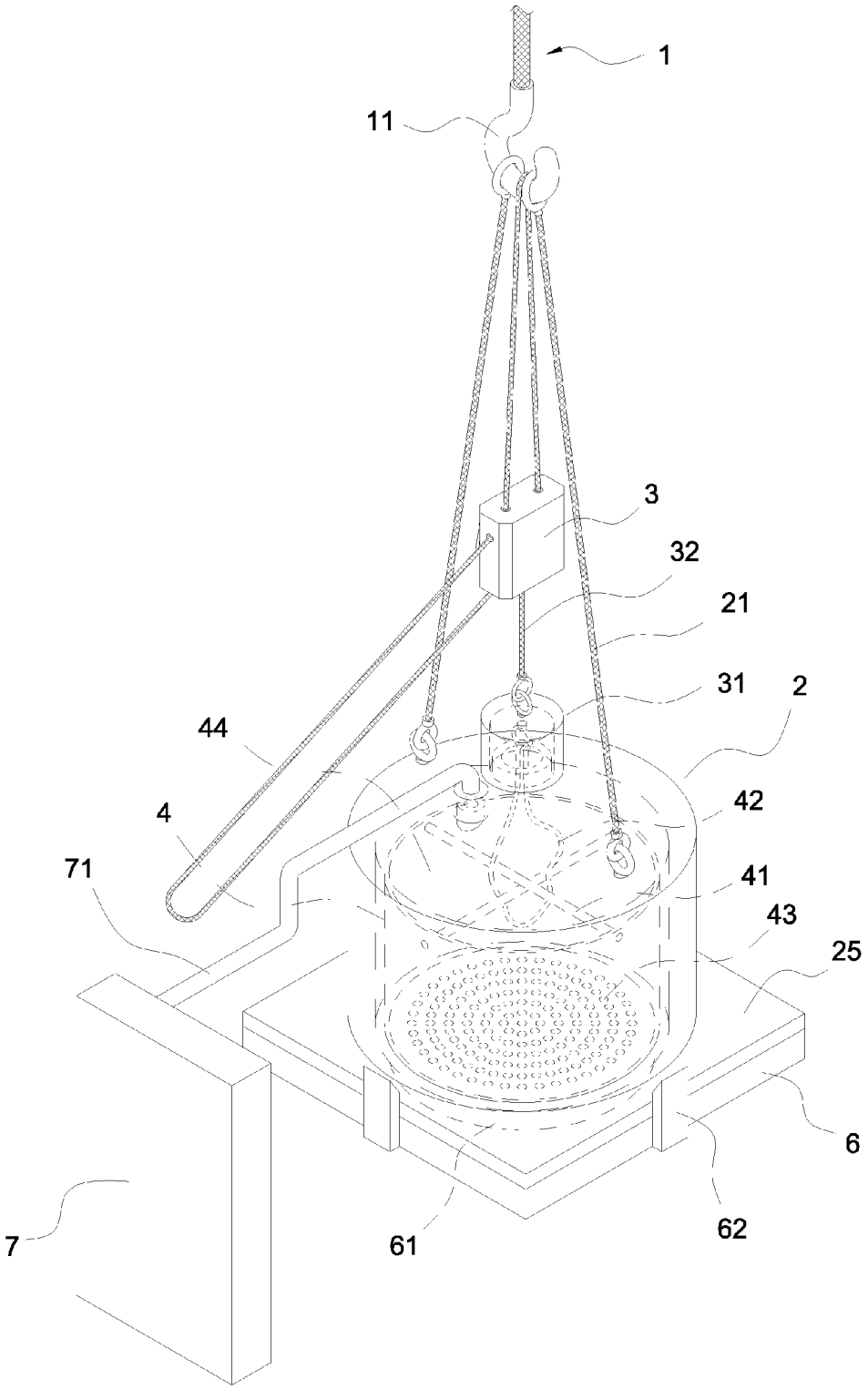
FIG. 6 is another perspective view showing the operations of the device of drying high-level radioactive wastes according to the preferred embodiment of the present invention.

In a step of S14, the basket 4 is further moved onto the heating tray 61 of the heating seat 6, the vacuum equipment 7 is connected with the air drawing orifice 24 of the shielding cover 2 through the discharging tube 71, as illustrated in FIG. 6; and then a heating equipment is started to heat the waters B of the radioactive wastes C up to 200° C., such that the waters B are evaporated. Thereafter, the vacuum equipment 7 is started to draw vapors, wherein as a vacuum degree in the shielding cover 2 decreases to 100 torr from at least 120 torr, a set vacuum condition is achieved, so the heating tray 61 and the vacuum equipment 7 are turned off. Thereby, the waters in the radioactive wastes C are eliminated so as to store the radioactive wastes C.

Accordingly, the method of drying high-level radioactive wastes and device thereof are capable of preventing exposure of persons working in a drying process in high high-level radioactive environment and enhancing safety of persons and storage.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method of drying high-level radioactive wastes comprising steps of:

placing a basket into a water tank in which radioactive wastes are stored and collecting the radioactive wastes in the basket, wherein a hanging device moves a basket to a storage tanks containing water in which radioactive wastes are stored, and the radioactive wastes in the storage tanks are moved into the basket;

moving the basket out of the water tank and placing the basket in a shielding cover; wherein the basket for collecting the radioactive wastes is lifted through a suspension mechanism and elevating mechanism above a water surface of the storage tank and is received in the shielding cover so that the basket moves the radioactive wastes without exposing radiation;

wherein the suspension mechanism includes a plurality of first hanging ropes connecting to a hook and the elevating mechanism includes a second hanging rope mounted below the hook of the suspension mechanism, wherein the second hanging rope extends downwardly from the bottom end of the elevating mechanism to couple with a cap for covering up a through hole of the shielding cover;

moving the basket into a water holder so as to drain water drops, wherein the basket is moved into a water holding groove of the water holder so as to drain the waters contained in the radioactive wastes; and hanging the basket on a heating tray and connecting the shielding cover with a vacuuming equipment so as to dry the radioactive wastes, wherein a vacuum equipment is connected with the shielding cover so as to heat and vacuum free waters in the radioactive wastes, wherein the through hole of the shielding cover is covered up with the cap through the elevating mechanism during vacuuming process.

2. The method of drying high-level radioactive wastes in claim 1, wherein the heating temperature of the heating tray is set at about 200° C.

3. The method of drying high-level radioactive wastes in claim 1, wherein the vacuum degree of the vacuum equipment is set at about 120 torr for turning on the vacuum equipment and set at about 100 torr for turning off the vacuum equipment.

4. The method of drying high-level radioactive wastes in claim 1, wherein the heating equipment is started to heat up to about 200° C., and then the vacuum equipment is started, thereafter as a vacuum degree in the shielding cover decreases to about 100 torr from at least 120 torr, the heating tray and the vacuum equipment are turned off.

* * * * *